United States Patent [19]

Kaneda

[11] 4,212,276

[45] Jul. 15, 1980

[54] AUTOMOBILE EVAPORATIVE EMISSION CONTROL DEVICE

[75] Inventor: Yoshihisa Kaneda, Hiroshima, Japan

[73] Assignee: Toyo Kogyo Co., Ltd., Hiroshima, Japan

[21] Appl. No.: 5,014

[22] Filed: Jan. 19, 1979

[30] Foreign Application Priority Data

Jan. 30, 1978 [JP] Japan ..... 53-10563[U]

[51] Int. Cl.[2] ..... F02M 33/02; F02M 37/00

[52] U.S. Cl. ..... 123/516; 123/586; 261/64 C

[58] Field of Search ..... 123/136, 119 DB, 198 E, 123/103 R, 97 B, 97 R; 261/64 C, DIG. 67

[56] References Cited

U.S. PATENT DOCUMENTS

| | | | |
|---|---|---|---|
| 3,368,326 | 2/1968 | Herbert | 123/136 |
| 3,540,423 | 11/1970 | Tolles | 123/136 |
| 3,561,412 | 2/1971 | Yagi | 123/119 DB |
| 3,678,912 | 7/1972 | Heusler | 123/136 |
| 3,683,878 | 8/1972 | Rogers | 123/136 |
| 3,888,223 | 6/1975 | Mondt | 123/136 |
| 4,013,054 | 3/1977 | Balsley | 123/136 |
| 4,059,088 | 11/1977 | Tateno | 123/103 R |
| 4,060,063 | 11/1977 | Hirasawa | 123/103 R |
| 4,062,910 | 12/1977 | Rogerson | 261/DIG. 67 |
| 4,144,852 | 3/1979 | Kawai | 123/97 B |

FOREIGN PATENT DOCUMENTS 2630180 1/1977 Fed. Rep. of Germany ... 123/119 DB

*Primary Examiner*—Charles J. Myhre
*Assistant Examiner*—Carl Stuart Miller
*Attorney, Agent, or Firm*—Wenderoth, Lind & Ponack

[57] ABSTRACT

In combination with an internal combustion engine having a throttle valve disposed in an intake manifold, an evaporative emission control device for controlling the emission to the atmosphere of fuel vapors from an internal combustion engine fuel system which comprises an air cleaner housing having a primary air intake conduit, a gating valve operatively disposed in the primary air intake conduit for selectively opening and closing the primary air intake conduit, a diaphragm valve assembly for bringing the gating valve means in position to open the primary air intake duct when a negative pressure developed in the intake manifold is induced in a working chamber, a fluid passage extending between the working chamber and the intake manifold, and a delay unit operable, when the negative pressure in the intake manifold decreases, for delaying a corresponding decrease of the once-induced negative pressure in the working chamber for a predetermined time to maintain the gating valve in the opened position.

8 Claims, 2 Drawing Figures

AUTOMOBILE EVAPORATIVE EMISSION CONTROL DEVICE

BACKGROUND OF THE INVENTION

The present invention relates to an automobile evaporative emission control device for controlling the emission to the atmosphere of fuel vapors from an internal combustion engine fuel system wherein the emission arises from the evaporation of the fuel.

It has generally been recognized by those skilled in the art that a major cause of air pollution so far as automobiles are concerned arises not only from the emission of combustion products through the exhaust system, but also from the fuel vapors emitted due to evaporation of the fuel. The U.S. Pat. No. 3,540,423 to Edward D. Tolles III, patented on Nov. 17, 1970, describes the possibility of air pollution resulting from the emission of the fuel vapors in automobiles and the importance of prevention of such fuel vapor emission. To this end, the E. D. Tolles' patent discloses an automobile evaporative emission control device which comprises an air filter or cleaner housing mounted on an intake manifold, leading to an engine combustion chamber or chambers through a carburetor; a gating valve operatively disposed in a primary air intake passage communicated to the atmosphere on one hand and, on the other hand, to the intake manifold through an annular adsorbent bed housed in the air cleaner housing, the gating valve being normally urged to a closed position by a biasing spring, but capable of being brought to an opened position in response to the negative pressure developed in the intake manifold at a position proximate to the throttle valve in the carburetor, the annular adsorbent bed defining a secondary air intake passage which extends through the central hollow of the annular adsorbent bed and is in communication with the intake manifold upstream of the carburetor and downstream of the adsorbent bed; and a pressure responsive two-way valve assembly so designed as to operate in such a manner that, when the engine is not operating or is operating at a low air consumption with no primary air introduced through the gating valve, a fluid circuit between the carburetor fuel bowl to the upstream side of the adsorbent bed can be established and, when increased engine air consumption is attained with the primary air introduced through the gating valve together with the secondary air, an alternative fluid circuit can be established between the carburetor fuel bowl and the intake manifold upstream of the throttle valve.

The pressure responsive two-way valve assembly employed in the Tolles' patent is comprised of a pressure responsive diaphragm valve and a two-way valve operatively coupled therewith while the gating valve is employed in the form of a butterfly valve.

The Tolles' patent also discloses the communication between the fuel tank and the first mentioned fluid circuit downstream of the pressure responsive two-way valve assembly, that is, between the fuel tank and a portion of the first mentioned fluid circuit which is between the pressure responsive two-way valve assembly and the annular adsorbent bed for withdrawing fuel vapors from the fuel tank to the adsorbent bed together with fuel vapors from the carburetor fuel bowl when the pressure responsive two-way valve assembly is held in position to establish the first mentioned fluid circuit.

The Japanese Utility Model Publication No. 47-10003 published on Apr. 14, 1972, discloses a similar automobile evaporative emission control device which comprises an air cleaner housing mounted on an intake manifold leading to an engine combustion chamber or chambers through a carburetor, the air cleaner housing having an air intake duct outwardly extending therefrom, said air intake duct including a gating valve, in the form of a butterfly valve, disposed therein for rotation between closed and opened positions and operatively coupled to a diaphragm valve. The diaphragm valve has a diaphragm member coupled to the gating valve through a connecting rod and being displaceable between a first position, in which the gating valve is held in the closed position, and a second position in which the gating valve is held in the opened position. This diaphragm valve is operatively associated with the intake manifold in such a manner that, when the engine is not operating or is operating at a low air consumption, the diaphragm is displaced to the first position with the gating valve consequently held in the closed position and, when the engine is operating at an increased air consumption, the diaphragm is displaced to the second position with the gating valve consequently held in the opened position for the introduction of air into the intake manifold through the air cleaner housing. For recovering fuel vapors from both of the intake manifold and the fuel tank, the emission control device disclosed in this Japanese Utility Model Publication further comprises a filter housing having two inlet ports, respectively communicated to the fuel tank and a portion of the air duct between the air cleaner housing and the gating valve whereby, while fuel vapors within the fuel tank are always introduced into the filter housing prior to the discharge thereof to the atmosphere irrespective of the engine operating condition, fuel vapors occurring in the intake manifold are introduced into the filter housing when and so long as the gating valve is held in the closed position. For operating the diaphragm valve, the negative pressure is drawn from the intake manifold from a position corresponding to a venturi section of the carburetor.

In the arrangement disclosed in the above mentioned Japanese Utility Model Publication, since the absolute value of the negative pressure developed in the venturi section of the carburetor is relatively small, the gating valve cannot be accurately and precisely operated between the closed and opened position and, more particularly, the gating valve can not readily be brought to the opened position during the engine idling condition.

However, the Japanese Utility Model Laid-open Publication No. 52-10211, laid open to public inspection on Jan. 24, 1977, discloses the use of an electromagnetic valve, instead of the butterfly valve employed in the above mentioned Japanese Utility Model Publication, for opening the air duct when and so long as the automobile ignition switch is turned on.

However, it has been found that the use of the electromagnetic valve requires consumption of an electric power, but also the electromagnetic valve itself is expensive.

Although less pertinent to the present invention than the prior art references hereinbefore discussed, the U.S. Pat. No. 3,683,878 to Joe E. Rogers, patented on Aug. 15, 1972, discloses the use of a gating valve of a type normally biased by a leaf spring to allow the passage of the primary air into the filter housing and then into the intake manifold while blocking the flow of air or fuel vapor in the opposite direction from the filter housing to the atmosphere. This type of gating valve may be considered a reed valve.

In any event, the conventional evaporative emission control devices particularly disclosed in the Tolles' patent and the Japanese Utility Model Publication involve a common disadvantage. As is well known to those skilled in the art, when the engine, which has been decelerated or has been operated at a relatively low velocity starts its acceleration to attain a relatively high velocity, the throttle valve is generally fully opened temporarily and the rate of flow of the primary air into the intake manifold by way of the air cleaner housing is consequently increased with the negative pressure present in the intake manifold at a position proximate to the throttle valve being reduced. In view of this, in the conventional evaporative emission control devices referred to above, the gating valve appears to be substantially closed during this transit period in which the engine is accelerated, to such an extent that the amount of the primary air to be introduced into the intake manifold tends to become short of the amount required during the substantially full opening of the throttle valve, the consequence of which is that the response of the engine to the acceleration is adversely affected.

SUMMARY OF THE INVENTION

Accordingly, the present invention has for its essential object to provide an improved evaporative emission control device for an automobile for controlling the emission to the atmosphere of fuel vapors not only from the intake manifold, but also from the fuel tank, which are free from the above described disadvantages and inconveniences inherent in the prior art devices of similar kind.

Another important object of the present invention is to provide an improved evaporative emission control device of the type referred to above, which is simple in construction and reliable in operation and which can readily be installed in operative connection with any existing internal combustion engine without inviting any possible reduction in performance of the engine.

A further important object of the present invention is to provide an improved evaporative emission control device wherein the gating valve can accurately and effectively be maintained at the full opening required during the transit period in which the engine is accelerated.

To this end, according to the present invention, there is provided an improved evaporative emission control device for an internal combustion engine having a fuel tank and an intake manifold including a carburetor for combining fuel from the fuel tank with primary air to form a combustible mixture, said carburetor having a throttle valve for controlling the rate of delivery of the combustible mixture to at least one combustion chamber of the engine through the intake manifold. The evaporative emission control device comprises an air cleaner housing communicated to one end of the intake manifold remote from the combustion chamber and upstream of the carburetor and having a primary air intake duct extending outwardly therefrom for the introduction of the primary air from the atmosphere into the intake manifold, a gating valve means disposed in the primary air intake duct and operable to allow the passage of the primary air from the atmosphere into the intake manifold through the air cleaner housing, but to block the flow of air or fuel vapors in the opposite direction from the intake manifold back towards the atmosphere, a first diaphragm valve assembly having a working chamber and a diaphragm member operatively coupled to the gating valve means and displaceable between a first position, in which the gating valve means is brought in a closed position, and a second position in which the gating valve means is brought in an opened position, a first fluid conduit means having one end communicated to the working chamber of the first diaphragm valve assembly and the other end opening towards the intake manifold at a position downstream of the throttle valve, and a fluid delay means disposed on said first fluid conduit means and operable to allow the pressure within the working chamber to become equal to the negative pressure within the intake manifold to displace the diaphragm member to the second position when the negative pressure within the intake manifold is high and to delay the rate of decrease of the once-created negative pressure within the working chamber for a predetermined time even when and after the negative pressure within the intake manifold is subsequently decreased.

For collecting fuel vapors arising from and drifting in the intake manifold and the air cleaner housing during the closure of the gating valve means and, hence, during an inoperative condition of the engine, the evaporative emission control device acccording to the present invention further comprises a second fluid conduit having a purifying unit through which the fuel vapors are vented. In addition, for periodically regenerating the filtering or adsorbent material in the purifying unit thereby avoiding the use of a purifying unit of a prohibitively large size and/or the replacement thereof at frequent intervals, there is also provided in the evaporative emission control device of the present invention a third fluid conduit means extending between the purifying unit and a portion of the intake manifold downstream of the throttle valve. This third fluid conduit means is opened only when the negative pressure is developed in the intake manifold to allow the passage of fuel vapors which have previously been deposited on the purifying or adsorbent material without being discharged to the atmosphere and which are removed or desorbed therefrom as a fresh air is drawn from the atmosphere into the third fluid conduit means through the purifying unit. A second diaphragm valve assembly operable by the effect of the negative pressure in the intake manifold and a switching valve are employed for selectively closing and opening the third fluid conduit means. The fuel tank may be communicated to the third fluid conduit means for the prevention of emission of fuel vapors from the fuel tank.

According to the present invention, the gating valve means may be of any known type, for example, a butterfly valve. However, the use is preferred of a type having an eccentrically rotatably supported valve member so that, so long as the flow of the primary air from the atmosphere through the primary air intake duct occurs and during the loaded drive of the engine, for example, acceleration, the reduction in negative pressure within the working chamber of the first diaphragm valve assembly can advantageously be retarded in cooperation with the fluid delay means by the reason which will become clear from the detailed description.

BRIEF DESCRIPTION OF THE DRAWING

These and other objects and features of the present invention will become apparent from the following description taken in conjunction with a preferred embodiment of the present invention with reference to the accompanying drawings, in which.

DETAILED DESCRIPTION OF THE INVENTION

Figure 1:
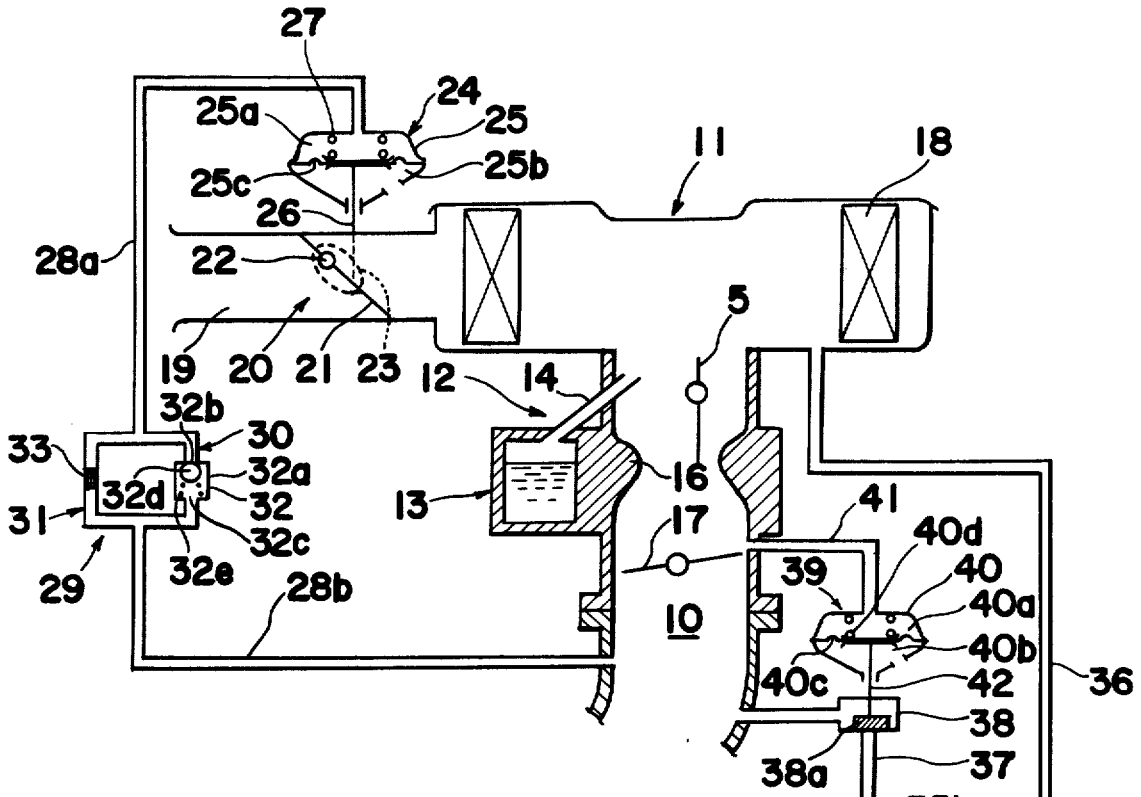
FIG. 1 is a schematic diagram showing an internal combustion engine having an evaporative emission control device installed according to the present invention.

Referring now to FIG. 1, there is shown an intake manifold 10 having an air cleaner housing 11 mounted on one end thereof, the other end of said intake manifold 10 being communicated to at least one combustion chamber of an internal combustion engine (not shown). The intake manifold 10 includes a carburetor 12 positioned between the air cleaner housing 11 and the engine combustion chamber and has a fuel bowl 13, an air vent tube 14, a choke valve 5, a venturi section 16 and a throttle valve 17, the detailed construction and operation of said carburetor 12 being well known to those skilled in the art and, therefore, omitted herein for the sake of brevity.

The air cleaner housing 11 is of a shape substantially similar to a closed circular box and includes an annular filtering bed 18 installed therein in coaxial relation to the open end of the intake manifold 10 opening towards the interior of the air cleaner housing 11. This air cleaner housing 11 has a primary air intake duct 19 extending radially outwardly from the periphery of the air cleaner housing 11 and opening towards the atmosphere so that a primary air can be introduced from the atmosphere into the intake manifold 10 after having past through the filtering bed 18.

A gating valve, generally designated by 20, is installed within the primary air intake duct 19 and comprises a valve member 21 rigidly mounted for eccentric rotation between closed and opened positions on a shaft 22 having one end rotataly journalled to a portion of the wall forming the primary air intake duct 19 and the other end rotataly extending through the opposite portion of the wall forming the primary air intake duct 19. This shaft 22 extends at right angles to and in laterally offset relation to the longitudinal axis of the primary air intake duct 19. Said other end of the shaft 22 situated outside of the primary air intake duct 19 has a motion translating lever 23 rigidly mounted thereon for rotation together with said shaft 22, which motion translating lever 23 is operatively coupled to a first diaphragm valve assembly 24 in a manner as will be described later.

The first diaphragm valve assembly 24 comprises a valve housing 25, the interior of which is divided into first and second chambers **25*a* and 25*b* by a diaphragm member 25*c*, the first chamber 25*a* being communicated to the intake manifold 10 in a manner as will be described later and the second chamber 25*b* communicated to the atmosphere, and a connecting rod 26 having one end rigidly connected to the diaphragm member 25*c* and the other end pivotally connected to the motion translating lever 23. The first diaphragm valve assembly 24 further comprises a biasing spring 27 accommodated within the first chamber 25*a* for urging the diaphragm member 25*c* to a first operative position thereby maintaining the gating valve 20 in the closed position as shown, said diaphragm member 25*c* being displaceable to a second operative position against the biasing spring 27 to bring the gating valve 20 to the opened position when a negative pressure is developed in the first chamber 25*a*. However, it is to be noted that the biasing spring 27 may be omitted if the diaphragm member 25*c* has a sufficient elasticity by which the diaphragm member 25*c* itself can be displaced to and maintained at the first operative position when no negative pressure is developed in the first chamber 25*a***.

The first chamber **25*a* of the first diaphragm valve assembly 24 is communicated to a portion of the intake manifold 10 downstream of the throttle valve 17 through a first conduit means constituted by fluid conduits 28*a* and 28*b* and including a fluid delay unit 29 disposed between the fluid conduits 28*a* and 28*b*. So far illustrated, the fluid delay unit 29 comprises first and second passages 30 and 31 extending in parallel relation to each other between the fluid conduits 28*a* and 28*b*, the first passage 30 including a check valve 32 so designed as to allow the passage of a fluid medium from the conduit 28*a* to the conduit 28*b*, but to block the passage of the fluid medium in the opposite direction from the conduit 28*b* to the conduit 28*a* while the second passage 31 includes a constricted area 33 such as constituted by an orifice. It is to be noted that the check valve 32 is shown as constituted by a casing 32*a* having a pair of opposed ports 32*b* and 32*c*, respectively communicated to the conduits 28*a* and 28*b*, a ball 32*d* and a biasing spring 32*e* normally urging the ball 32*d* to close the port 32*b***.

In the construction so far described, it will readily be seen that, when the negative pressure is developed in the intake manifold 10 downstream of the throttle valve 17, the ball **32*d* is displaced against the biasing spring 32*e* to open the port 32*b* with a major amount of fluid medium present within the first chamber 25*a* and the conduit 28*a* flowing into the conduit 28*b* while, when the negative pressure within the intake manifold 10 is subsequently decreased due, for example, to the subsequent full opening of the throttle valve 17, the ball 32*d* is held by the spring 32*d* in position to close the port 32*b* and, consequently, the fluid medium present in the conduit 28*b* is allowed to pass through the passage 31 by way of the constricted area 33 on to the conduit 28*a***.

For collecting fuel vapors resulting from evaporation of fuel in the intake manifold 10 and drifting in the intake manifold and the air cleaner housing 11 during the closure of the gating valve 20 in the manner as shown in FIG. 1, a purifying unit 34 is employed. This purifying unit 34 comprises a canister 35 having first and second inlet ports **35*a* and 35*b* and a vent port 35*c* and including a purifying bed 35*d* which may be composed of any known filtering material or any known adsorbent material such as activated carbon particles. This purifying unit 34 is fluid connected to the air cleaner housing 11 by means of a second conduit 36 having one end, extending through the first inlet port 35*a* into the purifying bed 35*d*, and the other end held in communication with the air cleaner housing 11 at a position downstream of the filtering bed 18 with respect to the direction of flow of the primary air from the primary air intake duct 19 into the intake manifold 10**.

For periodically regenerating the purifying bed **35*d* within the canister 35 by the removal of fuel vapors deposited on the purifying bed 35*d*, there is employed a third conduit means which comprises a third conduit 37 having one end communicated to the second inlet port 35*b* of the purifying unit 34 and the other end communicated to the intake manifold 10 at a position downstream of the carburetor throttle valve 17, a substantially intermediate portion of said third conduit 37 having a switching valve 38 installed thereon for selectively opening and closing the third fluid conduit 37. This switching valve 38 includes a valving member 38***a* held in position to selectively close and open the third fluid conduit 37 according to the magnitude of the negative pressure developed in the intake manifold 10. For this purpose, there is employed a second diaphragm valve assembly 39 which comprises a valve housing 40, the interior of which is divided into first and second chambers 40*a* and 40*b* by a diaphragm member 40*c*. The first chamber 40*a* is communicated by a conduit 41 to a portion of the intake manifold 10 proximate to the throttle valve 17 and, more particularly, slightly upstream of the throttle valve 17 when the latter is held in a substantially closed position and downstream of the throttle valve 17 when the latter is rotated a small angle to open from the substantially closed position, whereas the second chamber 40*b* is communicated to the atmosphere. The diaphragm member 40*c* is displaceable between first and second positions, but is normally biased to the first position by a biasing spring 40*d* accommodated within the first chamber 40*a*. This diaphragm member 40*c* is operatively connected to the valving member 38 *a* of the switching valve 38 so that, when the diaphragm member 40*c* is displaced towards the second position against the biasing spring 40*d*, the valving member 38*a* can be brought in position to open the third fluid conduit 37. The displacement of the diaphragm member 40*c* from the first position towards the second position against the biasing spring 40*d* takes place when the negative pressure is induced in the first chamber 40*a* through the conduit 41.

A fuel tank 43 is shown to be fluid connected to a portion of the third fluid conduit 37 between the purifying unit 34 and the switching valve 38 by means of a fluid conduit 44 so that fuel vapors drifting within the fuel tank 43 and above the top level of the fuel within such tank 43 can be introduced into that portion of the third fluid conduit 37 and/or canister and, when the valving member 38*a* is held in position to open the third fluid conduit 37, into the intake manifold 10.

While the evaporative emission control device of the present invention is constructed as hereinbefore described, it operates in the following manner. It is, however, to be noted that, for better understanding of the present invention, the operation of the evaporative emission control device will now be described according to its different operative conditions.

Inoperative Condition

When the automobile engine which has been operated is brought to an inoperative condition with an ignition switch (not shown) turned off, a so-called "hot soak" period commences and fuel droplets wetting to the inner surface of the intake manifold 10 and fuel within the carburetor bowl 13 evaporate under the influence of the ambient temperature, thereby tending to escape to the atmosphere through the air cleaner housing 11. However, since the pressure within the intake manifold 10 becomes equal to the atmospheric pressure as soon as the engine is shut off, the pressure within the intake manifold 10 is introduced into the first chamber 25*a* of the first diaphragm valve assembly 24 through the conduit 28*b*, then the constricted area 33 on the passage 31 and finally through the conduit 28*a*, whereby the diaphragm member 25*c* which has been displaced to the second position against the spring 27 is urged back to the first position by the action of the spring 27. This displacement of the diaphragm member 25*c* back to the first position causes the gating valve 20 to assume the closed position as shown and, therefore, the fuel vapors arising from the intake manifold 10 and subsequently drifting in the air cleaner housing 11 will not escape to the atmosphere through the primary air intake duct 19, but flow through the conduit 36 into the purifying unit 34 whereat the fuel vapors are deposited on or adsorbed by the purifying bed 35*d* prior to being discharged to the atmosphere through the vent or outlet port 35*c* of the purifying unit 34.

It is to be noted that not only the fuel vapors so introduced into the purifying unit 34 in the manner described above, but also fuel vapors within the fuel tank 43 will not be circulated into the intake manifold 10 through the third fluid conduit 37 during the inoperative condition of the engine. This is because the pressure within the intake manifold 10, which is equalized to the atmospheric pressure as hereinbefore described, is also introduced into the first chamber 40*a* of the second diaphragm valve assembly 39 through the conduit 41 with the diaphragm member 40*c* displaced to the first position by the action of the spring 40*d* and, therefore, the valving member 38*a* of the switching valve 38 is held in position to close the third fluid conduit 37.

Operative Condition (I) Engine Start and Idling

When and after the ignition switch is turned on to start the engine, a starter (not shown) is operated to rotate the engine. As the engine is so rotated by the starter, a negative pressure is developed in the intake manifold 10 downstream of the throttle valve 17 and, accordingly, this negative pressure is induced in the first chamber 25*a* of the first diaphragm valve assembly 24 through the check valve 32 then opened. More specifically, as the negative pressure is developed in the intake manifold 10 downstream of the throttle valve 17 in the manner described above, air present within the first chamber 25*a* is drawn into the intake manifold 10 forcing the ball 32*d* to displace against the spring 32*e* to open the port 32*d* and, consequently, a negative pressure of a value substantially equal to the negative pressure within the intake manifold 10 downstream of the throttle valve 17 is developed in the first working chamber 25*a* with the diaphragm member 25*c* displaced towards the second position against the spring 27. Therefore, the gating valve 20 is opened to such an extent as to allow the passage of the primary air therethrough into the intake manifold 10 via the air cleaner housing 11 in an amount required to start the engine.

As the engine starts its operation, an increased negative pressure is developed in the intake manifold 10 at a position downstream of the throttle valve 17, which is in turn induced in the first chamber 25*a* to displace the diaphragm member 25*c* to the second position with the gating valve 20 consequently fully opened. Accordingly, even when the engine is subsequently driven at an idling speed, the gating valve 20 can be maintained at the full open position.

It is to be noted that the throttle valve 17 is substantially closed during the start and idling of the engine and, therefore, the pressure introduced in the duct 41 is still equal to or slightly higher than the atmospheric pressure because the end of the duct 41 remote from the first chamber 40a of the second diaphragm valve assembly 39 opens towards the intake manifold 10 at a position upstream of the throttle valve 17 in the substantially closed position. Therefore, the diaphragm member 40c of the second diaphragm valve assembly 39 is maintained at the first position as biased by the spring 40d as shown and the switching valve 38 is held in position to close the fluid conduit 37.

(II) Loaded Drive of the Engine

When the engine is subsequently driven under load with the throttle valve 17 opened, the negative pressure which has been developed in the intake manifold 10 at a position downstream of the throttle valve 17 decreases. When this decrease takes place, the check valve 32 is immediately brought in a position to interrupt the communication between the ducts 28a and 28b by way of the passage 30 with the ball 32d held in position to close the port 32d as biased by the spring 32e. Accordingly, the negative pressure, which has been induced in the first chamber 25a of the first diaphragm valve assembly 24 during the idling operation of the engine, is substantially maintained in the first chamber 25a, thereby preventing the closure of the gating valve 20 during the loaded drive of the engine.

On the other hand, the pressure within the first chamber 25a tends to become equal to the pressure in the duct 28b and, hence, the pressure in the intake manifold 10 downstream of the throttle valve 17, since the ducts 28a and 28b are communicated to each other through the constricted area 33 on the passage 31 even when the check valve 32 is in position to close the passage 30. However, because of the design of the constricted area 33, the time required for the pressure in the conduit 28a and, hence, that in the first chamber 25a, to become equal to the pressure in the conduit 28b can be prolonged. By way of example, if the system is so designed that the gating valve 20 can be fully opened when the negative pressure of about −20 mmHg is introduced in the first chamber 25a, there is no possibility that the gating valve 20 will be closed since the negative pressure developed in the intake manifold 10 during the loaded drive of the engine is usually about −30 mmHg. On the other hand, it is admitted that the negative pressure of about −20 mmHg will be developed in the intake manifold 10 during a low speed, high load drive of the engine which often continues for a relatively short period of time, in which case the premature closure of the gating valve 20 can be avoided by suitably selecting the effective cross sectional area of the constricted area 33.

On the other hand, during the loaded drive of the engine, the throttle valve 17 is opened and, therefore, the opening of the end of the duct 41 remote from the first chamber 40a of the second diaphragm valve assembly 39 is positioned downstream of the throttle valve. Accordingly, the negative pressure developed in the intake manifold 10 downstream of the throttle valve 17 is induced in the first working chamber 40a with the diaphragm member 40c consequently displaced towards the second position against the spring 40d. The displacement of the diaphragm member 40c towards the second position so effected causes the switching valve 38 to open the third fluid conduit 37 to allow the fuel vapors, which have been deposited on the purifying bed 35d in the purifying unit 34 and are subsequently removed or desorbed therefrom, to flow through the third fluid conduit 37 into the intake manifold 10 and then into the engine combustion chamber. The removal or desorption of the fuel vapors from the purifying bed 35d takes place as a fresh air from the atmosphere passes into the conduit 37 through the purifying bed 35d by way of the port 35c by the effect of a pressure differential between the atmosphere and the intake manifold 10 and, consequently, the purifying bed 35d can effectively be regenerated. Simultaneously therewith, fuel vapors arising from the fuel tank 43 are also introduced into the intake manifold 10 by means of the conduit 44 and then the conduit 37.

It is to be noted that the use of the eccentrically rotatably supported valve member 21 for the gating valve 20 is advantageous in that, even when the first diaphragm valve assembly 24 fails to operate properly during, for example, a high load drive of the engine or is malfunctioned, the gating valve 20 can be opened by the effect of the flow of the primary air being sucked into the intake manifold 10 under the influence of the negative pressure then developed in the intake manifold 10.

It is also to be noted that the system for collecting the fuel vapors from the intake manifold 10 and the air cleaner housing 11 during the closure of the gating valve 20 and for subsequently regenerating the purifying bed 35d may not be limited to that described with reference to and shown in FIG. 1, but may be of any known type. By way of example, depending upon the type of the purifying material forming the purifying bed 35d, the third fluid conduit 37 and its associated arrangement including the second diaphragm valve assembly 39 may not be omitted with the conduit 44 fluid connected to the duct 36. Alternatively, the system for collecting the fuel vapors from the intake manifold and for regenerating the purifying bed disclosed in the Tolles' patent referred to above may be employed with no substantial modification.

Figure 2:
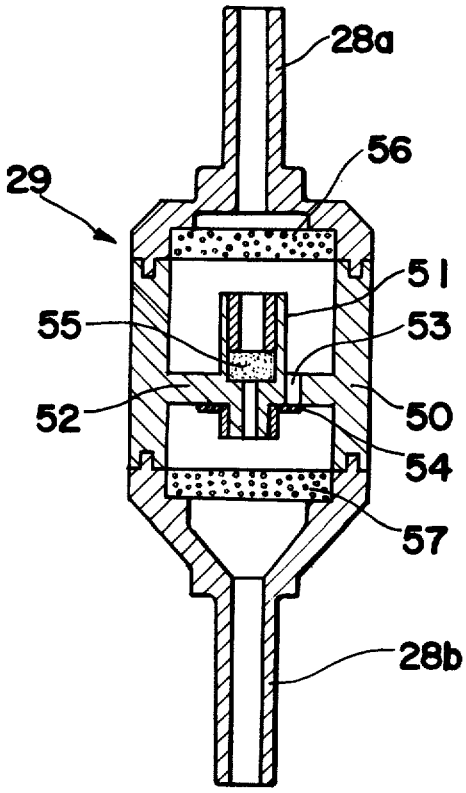
FIG. 2 is a schematic longitudinal sectional view showing a practically employable version of a fluid delay unit employed in the evaporative emission control device shown in FIG. 1.

In practice, the fluid delay unit 29 is constructed in a manner as shown in FIG. 2, reference to which will now be made. It is, however, to be noted that this does not means that the combined arrangement of the check valve 32 and the constricted area 33 shown in FIG. 1 cannot be practically employed.

Referring now to FIG. 2, the delay unit 29 comprises a substantially hollow cylindrical casing 50 having its opposed ends communicated to the conduits 28a and 28b, respectively, and a tube 51 rigidly supported within the casing 50 by means of an annular partition wall 52 which protrudes radially outwardly from the inner peripheral surface of the casing 50 and terminating in integral contact with the outer peripheral surface of the tube 51. The annular partition wall 52 is formed with at least one aperture 53 extending completely through the thickness of the partition wall 53, which aperture 53 has one open end adjacent the conduit 28b adapted to be selectively closed and opened by a valve member 54, the valve member 54 being so designed as to allow the passage of the fluid medium from the conduit 28a towards the conduit 28b through the aperture 53, but block the flow of the fluid medium in the opposite direction from the conduit 28b towards the conduit 28a through the aperture 53. It will, therefore, readily be seen that the fluid passage including the aperture 53 and the valve member 54 possibly corresponds in function to the passage 30 including the check valve 32 shown in FIG. 1.

Within the hollow of the tube 51 which corresponds to the passage 31 shown in FIG. 1, there is filled a porous barrier 55, made of an open-celled porous metallic material such as a sintered alloy, which functionally corresponds to the constricted area 33 shown in FIG. 1. The term "porous" employed hereinabove and in the appended claims in connection with the barrier 55 is to be understood as meaning that the material for the barrier 55 has a plurality of voids or pockets which are interconnected in such a manner that gas may pass from one to another. In this sense, the porous material may be referred to as an open-celled material.

Reference numerals 56 and 57 represent respectively filtering material positioned adjacent the openings at the opposite ends of the casing 50.

Although the present invention has fully been described in connection with the preferred embodiment thereof, it is to be noted that various changes and modifications are apparent to those skilled in the art. By way of example, in addition to the changes and modifications such as described above, the conduit **28*b* may be fluid connected to a portion of the conduit 37 between the intake manifold 10 and the switching valve 38 or that portion of the conduit 37 may be fluid connected to the conduit 28*b***.

Accordingly, such changes and modifications are to be understood as included within the true scope of the present invention unless they depart therefrom.

I claim:

1. In combination with an internal combustion engine having an intake manifold leading to at least one combustion chamber and including a carburetor having a throttle valve disposed in the intake manifold for combining fuel from a fuel tank with primary air to form a combustible mixture to be supplied into the combustion chamber, an evaporative emission control device which comprises:

an air cleaner housing, the interior of which is fluid connected to one end of the intake manifold remote from the combustion chamber, said air cleaner housing having a primary air intake duct communicating the interior of the air cleaner housing to the atmosphere;

a gating valve means disposed in said primary air intake duct and operable to selectively close and open the primary air intake duct;

a first diaphragm valve assembly having a compartment divided into first and second working chambers by a diaphragm member, said second working chamber being in communication with the atmosphere and said diaphragm member being operatively connected to said gating valve means and displaceable between a first position, in which the gating valve means is held in position to close the primary air intake duct, and a second position in which the gating valve means is held in position to open the primary air intake duct;

a first fluid passage means extending between the first working chamber and the intake manifold and through which air contained in the first working chamber is drawn into the intake manifold, when a negative pressure is developed in the intake manifold, to create a negative pressure in the first working chamber to displace the diaphragm member towards the second position;

means disposed on said first fluid passage means and operable, when the negative pressure in the intake manifold decreases, for delaying a corresponding decrease of the negative pressure in the first working chamber for a predetermined time to maintain the gating valve means in the opened position; and a purifying unit for collecting fuel vapors resulting from evaporation of fuel in an engine fuel system during an inoperative condition of the engine with no negative pressure developed in the intake manifold.

2. An evaporative emission control device as claimed in claim 1, wherein said gating valve means comprises a support shaft extending across the primary air intake duct at right angles to and in laterally offset relation to the longitudinal axis of the primary air intake duct, and a valve member rigidly mounted on said shaft within the primary air intake duct.

3. An evaporative emission control device as claimed in claim 1, wherein said first fluid passage means is constituted by first and second passage portions, the first passage portion having one end communicated to the first working chamber and the second passage portion having one end communicated to the intake manifold at a position downstream of the throttle valve, and wherein said delaying means comprises first and second passages extending in parallel relation to each other between the respective other ends of said first and second passage portions, said first passage having a check valve disposed thereon and operable to allow the flow of the air from the first working chamber in one direction from the first passage portion towards the second passage portion, but to block the flow of the air in the opposite direction, said second passage having a constricted area defined therein.

4. An evaporative emission control device as claimed in claim 1, wherein said first fluid passage means is constituted by first and second passage portions, the first passage portion having one end communicated to the first working chamber and the second passage portion having one end communicated to the intake manifold at a position downstream of the throttle valve, and wherein said delaying means comprises a tubular casing having its opposed ends fluid connected to the respective other ends of the first and second passage portions, a partition wall positioned in and dividing the interior of the tubular casing into first and second compartments, a tubular member rigidly supported by said partition wall and communicating between said first and second compartments to each other, an aperture defined in and completely extending through the partition wall and communicating the first and second compartments, a valving member rigidly carried by said partition wall and operable to allow the flow of the air from the first compartment to the second compartment, but to block the flow of the air in the opposite direction from the second compartment to the first compartment, and a flow resistance element filled in the hollow of the tubular member.

5. An evaporative emission control device as claimed in claim 1, wherein said purifying unit comprises a canister having first and second ports and a purifying bed accommodated within said canister, and further comprising a second fluid passage means extending from the air cleaner housing and terminating in the purifying bed after having past through the first port, the second port being communicated to the atmosphere.

6. An evaporative emission control device as claimed in claim 5, wherein said canister further has a third port, and further comprising means for periodically regenerating the purifying bed.

7. An evaporative emission control device as claimed in claim 6, wherein said regenerating means comprises a third fluid passage means extending between the third port of the canister and the intake manifold, a switching valve means for selectively opening and closing the third fluid passage means and a valve actuating means for bringing said switching valve means in position to open the third fluid passage means only when the negative pressure is developed in the intake manifold.

8. An evaporative emission control device as claimed in claim 7, further comprising a duct having one end communicated to the fuel tank and the other end communicated to a portion of the third fluid passage means between the third port and the switching valve means.

* * * * *